US006255946B1

(12) United States Patent
Kim

(10) Patent No.: US 6,255,946 B1
(45) Date of Patent: Jul. 3, 2001

(54) SYSTEM FOR DETECTING AN OBJECT PASSING THROUGH A GATE

(76) Inventor: Jae Han Kim, E-903 Misung Apt., 37 Yoido-dong, Youngdungpo-gu, Seoul 150-010 (KR)

( * ) Notice: Subject to any disclaimer, the term of this patent is extended or adjusted under 35 U.S.C. 154(b) by 0 days.

(21) Appl. No.: 09/514,305

(22) Filed: Feb. 28, 2000

(30) Foreign Application Priority Data

Mar. 22, 1999 (KR) ..... 99-9593

(51) Int. Cl.[7] ..... G08B 13/18
(52) U.S. Cl. ..... 340/556; 250/221
(58) Field of Search ..... 340/556, 557, 340/555; 250/221

(56) References Cited

U.S. PATENT DOCUMENTS

| | | | | |
|---|---|---|---|---|
| 3,787,693 | * | 1/1974 | Stone | 250/330 |
| 4,009,389 | * | 2/1977 | Lindholm | 250/221 |
| 4,272,762 | * | 6/1981 | Geller et al. | 340/556 |
| 4,277,727 | * | 7/1981 | Levert | 340/556 X |
| 4,410,884 | * | 10/1983 | Heiland | 340/556 X |
| 4,507,654 | * | 3/1985 | Stolarczyk et al. | 340/556 X |
| 4,516,115 | * | 5/1985 | Frigon et al. | 340/556 |
| 4,719,363 | * | 1/1988 | Gallacher | 340/556 X |
| 4,736,097 | * | 4/1988 | Philipp | 250/221 |
| 4,816,667 | * | 3/1989 | Meinert | 250/221 |
| 5,353,149 | * | 10/1994 | Urakami et al. | 359/326 |
| 5,656,900 | | 8/1997 | Michel et al. | 318/286 |

* cited by examiner

*Primary Examiner*—Thomas Mullen
(74) *Attorney, Agent, or Firm*—Shanks & Herbert

(57) ABSTRACT

A system for detecting the presence and direction of an object passing through a gate, for example, a door of a building or a room, and announcing the detection result to the operator or persons in the building or the room. The system detects an object passing through a gate supported laterally by a frame. The system comprises a reflector, signal generating and determining means, and a user interface. The reflector is disposed at an edge of the frame. The signal generating and determining means is disposed at the other edge of the frame so as to face the reflector. The signal generating and determining means generates a first and a second infrared beams to emit to the reflector, receives a mixed beam in which the first and the second beams reflected by the reflector are superimposed, and determines the presence and direction of the object passing through the gate based on the mixed beam. The user interface notifies a user of the presence and direction of the object when the object passes through the gate and receives an operation command from the user. The signal generating and determining means comprises first and second infrared emitters for generating the first and the second infrared beams, respectively. The first and the second infrared emitters are mounted in a single housing.

12 Claims, 8 Drawing Sheets

SYSTEM FOR DETECTING AN OBJECT PASSING THROUGH A GATE

BACKGROUND OF THE INVENTION

1. Field of the Invention

The present invention relates to an object detection apparatus, and more particularly, an object detection apparatus using an infrared signal. This application for the object detection apparatus is based on Korean patent application No. 1999-9593, which is incorporated by reference herein for all purposes.

2. Description of the Related Art

An object detection apparatus for detecting persons in a room typically employs passive sensors. The passive sensors detect thermal radiation from a person located in a certain detection angle range. The sensitivity of such an detection apparatus may be varied by an adjustment of the detection angle range of each passive sensor, which usually is set to be wide enough. The passive sensor, however, may operate erroneously according to the change of the room temperature and be influenced by an external interference. Accordingly, the object detection apparatus employing passive sensors can be used only in a room, but not out of a building. Further, the passive sensor cannot detect an object when the object is distant from the sensor, and thus is inadequate in an application where a precise detection is required.

In order to overcome such drawbacks, another conventional object detection apparatus uses an infrared beam to detect the presence of an object. The object detection apparatus comprises an infrared emitter constantly emitting the infrared beam and an infrared sensor disposed to face the infrared emitter and receiving the infrared beam from the emitter. When an object crosses a beam path between the infrared emitter and the infrared sensor, a blank period is introduced in the beam received by the infrared sensor. The apparatus detects the presence of the object by determining such a blank period. The apparatus, however, cannot determine the direction of the object, that is, whether the object enters or exits the room, when the object is detected.

As an approach for detecting the presence as well as the direction of the object passing through a gate, it can be contemplated to dispose a pair of the detection apparatuses in parallel and combine the detection data from the apparatuses. It is difficult to carry out arranging two detection apparatuses at a gate, however, because construction work has to be performed for four positions near the gate in addition to installing a separate module for combining detection data from the apparatuses.

On the other hand, the object detection apparatus is installed for each gate. In this regard, there has not been proposed a low cost system having a console for aggregating data from a plurality of object detection apparatuses, displaying synthetically the data or ringing a chime upon receiving a detection signal from one of the gates, and managing the apparatuses. Security providing companies operate a system for displaying data from multiple object detection apparatuses in a single display panel. Since being relatively expensive, however, it is inappropriate to install such a system in a small building having plural gates or independently in a single floor of a building.

SUMMARY OF THE INVENTION

To solve the problems above, one object of the present invention is to provide a sensor assembly which is simple and compact and capable of detecting the presence and direction of an object passing through a gate precisely.

Another object of the present invention is to provide a low cost system for detecting the presence and direction of an object passing through a gate, for example, a door of a building or a room, and announcing the detection result to the operator or persons in the building or the room.

A sensor assembly for achieving one of the above objects is suitable for use in a system for detecting an object passing through a gate and includes a reflector and an infrared transceiver. The infrared transceiver may be disposed to face the reflector. The infrared transceiver generates a first and a second infrared beams to emit to the reflector and receives a mixed beam in which the first and the second beams reflected by the reflector are superimposed. According to the present invention, the infrared transceiver comprises a first and second infrared emitters for generating the first and the second infrared beams, respectively. The first and the second infrared emitters are mounted in a single housing.

A system for achieving another one of the above objects detects an object passing through a gate supported laterally by a frame. The system comprises a reflector, signal generating and determining means, and a user interface. The reflector is disposed at an edge of the frame. The signal generating and determining means is disposed at the other edge of the frame so as to face the reflector. The signal generating and determining means generates a first and a second infrared beams to emit to the reflector, receives a mixed beam in which the first and the second beams reflected by the reflector are superimposed, and determines the presence and direction of the object passing through the gate based on the mixed beam. The user interface notifies a user the presence and direction of the object when the object passes through the gate and receives an operation command from the user.

The signal generating and determining means comprises a first and second infrared emitters for generating the first and the second infrared beams, respectively. The first and the second infrared emitters are mounted in a single housing.

The sensor assembly of the present invention is compact because it comprises a single reflector and a single infrared receiver, and can simply be installed near a gate. Also, according to the present invention, it is possible to detect the presence as well as the direction of an object passing through a gate by use of a single sensor assembly at the gate. Particularly, because a single user interface can be interfaced with plural reflectors and signal generation and detection units, the system according to the present invention facilitates the monitoring of objects passing gates, at a glance, in a building or a room having a plurality of gates.

BRIEF DESCRIPTION OF THE DRAWINGS

The above objectives and advantages of the present invention will become more apparent by describing in detail preferred embodiments thereof with reference to the attached drawings in which.

DESCRIPTION OF THE PREFERRED EMBODIMENTS

Figure 1:
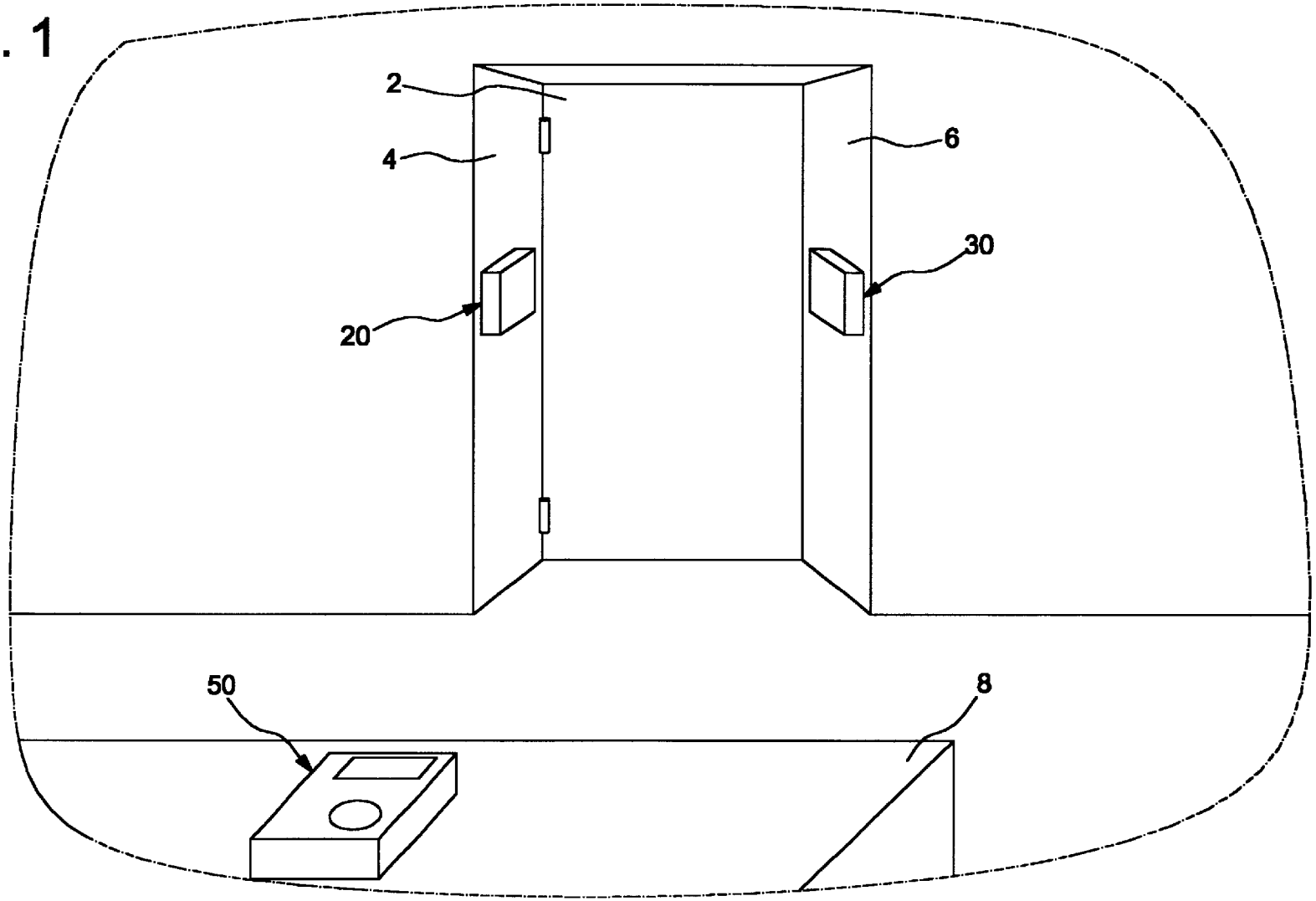
FIG. 1 is a perspective view of a preferred embodiment of an object detection system according to the present invention.

In an exemplary application shown in FIG. 1, an object detection system according to the present invention detects a human body passing through the door 2 of an office or a building and announce the presence and moving direction of the human body passing through the door 2. In the preferred embodiment, the apparatus includes a reflector 20, a signal generating and determining unit 30, and a user interface 50. The reflector 20 is installed on a framework 4 of the door 2, while the signal generating and determining unit 30 is installed on another framework 6 of the door 2 so as to face the reflector 20. The user interface 50 may be disposed on the table 8 of an operator or on the wall.

The signal generating and determining unit 30 outputs two infrared pulse trains to the reflector 20 and receives two infrared pulse trains reflected by the reflector 20 to determine the presence and moving direction of the human body passing through the door 2. When detecting the human body, the signal generating and determining unit 30 outputs a detection signal indicating the presence and direction of the human body to the user interface 50. In response to the detection signal, the user interface 50 beeps to announce the presence of the human body entering or exiting the room to the operator or the other persons in the room. The user interface 50 displays the accumulated number of human bodies having passed through the door 2 or total number of persons in the room. Also, the user interface 50 allows the operator to input an operational instruction for changing the operation mode or setting up variables of the system.

In the preferred embodiment, the signal generating and determining unit 30 and the user interface 50 interfaces each other through a wireless link of a weak RF signal having a frequency of 310 MHz or 420 MHz. Alternatively, the signal generating and determining unit 30 and the user interface 50 may be connected to each other by use of a wire pair.

Figure 2:
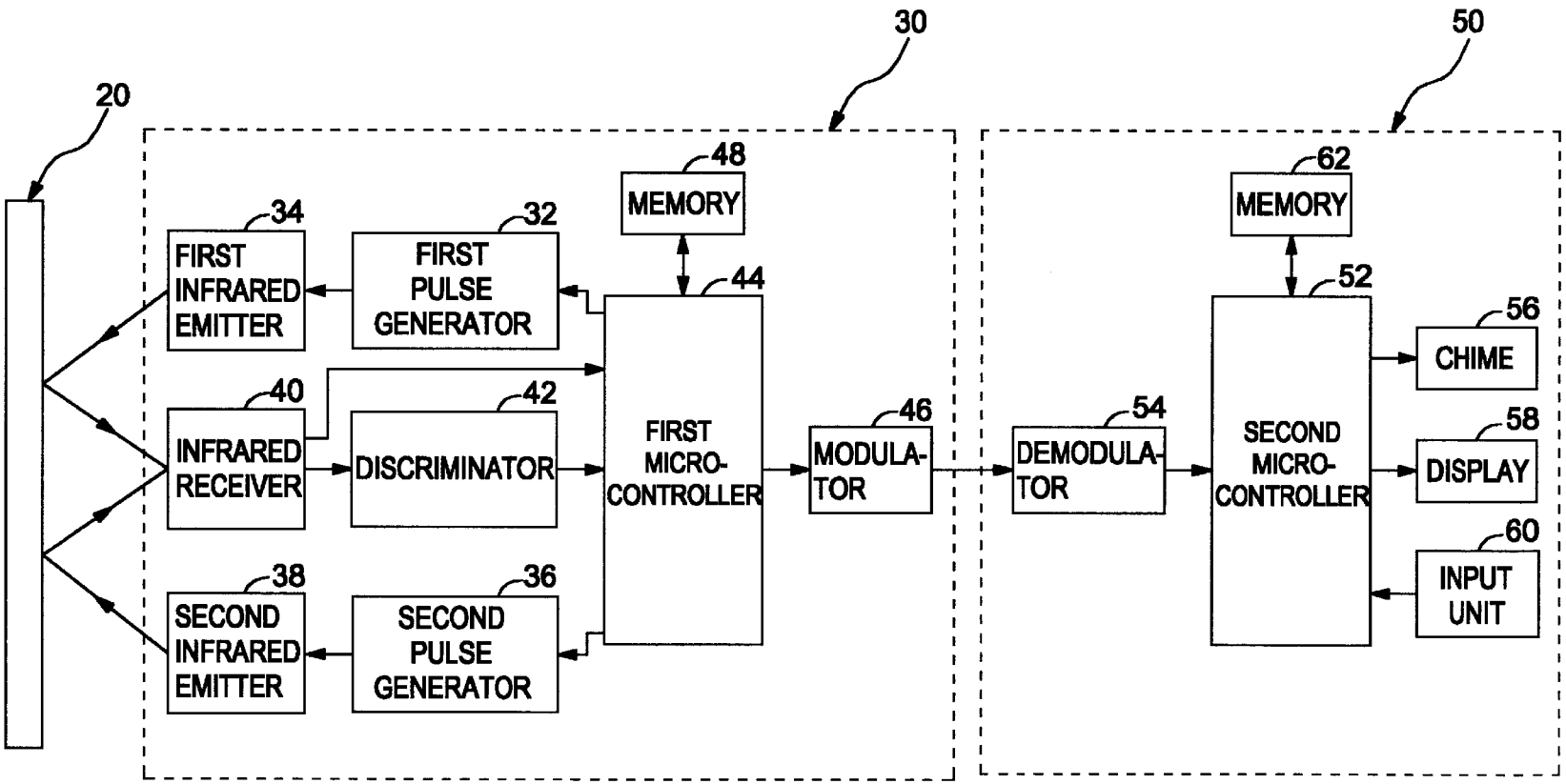
FIG. 2 is a block diagram of the object detection system of FIG. 1.

FIG. 2 is a schematic diagram of the object detection system of FIG. 1.

In the signal generating and determining unit 30, a first pulse generator 32 generates a first pulse train under the control of a microcontroller 44 to provide such pulse train to a first infrared emitter 34. The first infrared emitter 34 outputs a first infrared signal to the reflector 20 in response to the first pulse train. Also, a second pulse generator 36 generates a second pulse train under the control of the microcontroller 44 to provide such pulse train to a second infrared emitter 38. The second infrared emitter 38 outputs a second infrared signal to the reflector 20 in response to the second pulse train.

An infrared receiver 40 receives a mixed reflection signal in which a first reflected signal formed by the reflection of the first infrared signal at the reflector 20 is superimposed with a second reflected signal formed by the reflection of the second infrared signal at the reflector 20. The infrared receiver 40 transduces the mixed reflection signal into an electrical signal to output a reflected pulse train. Also, the infrared receiver 40 includes a level determination circuit for determining the levels of the reflected infrared signals, which is described below in detail. A discriminator 42 receives the reflected pulse train, determines the presence and moving direction of the human body passing through the door 2 according to the reflected pulse train, and outputs the determination result to the microcontroller 44. When it is determined that a human body enters or exits the room through the door, the microcontroller 44 outputs a detection signal to the user interface 50 via a modulator 46 which demodulates the detection signal. Meanwhile, a memory 48, which is preferably an EEPROM, stores program codes for operating the microcontroller 44 and setup data for initializing the apparatus.

Figure 3:
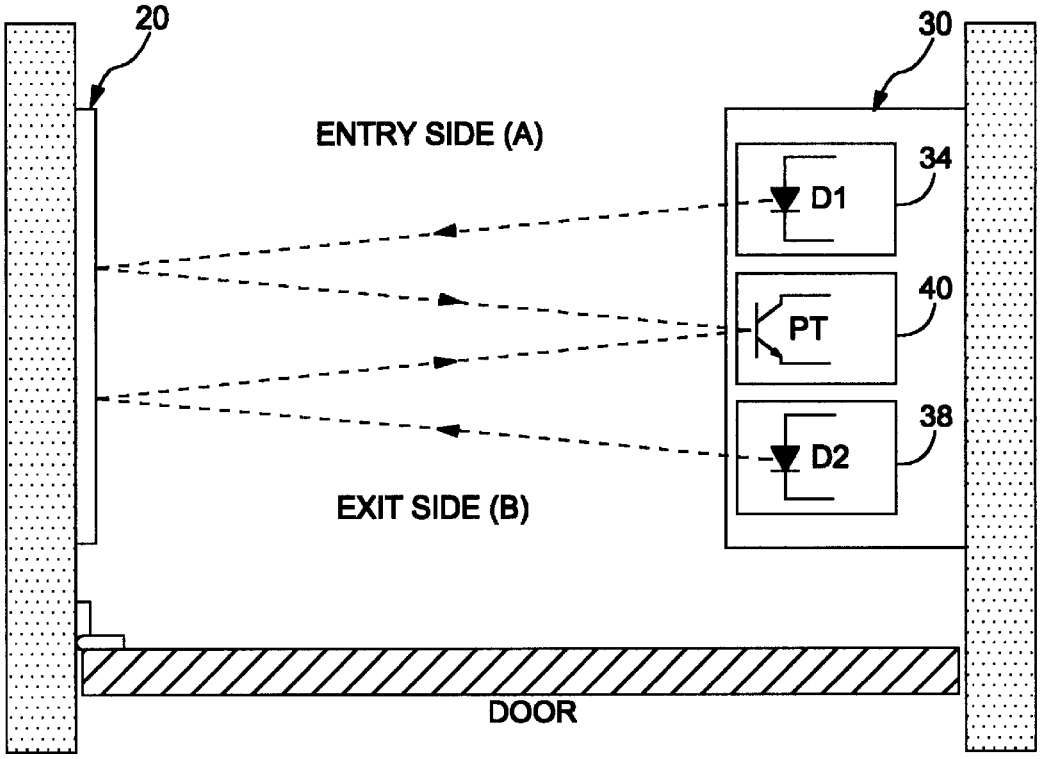
FIG. 3 illustrates the arrangement of the infrared emitters, the reflector, and the infrared receiver along with optical paths therebetween.

FIG. 3 illustrates, in more detail, the arrangement of the infrared emitters 34 and 38, the reflector 20, and the infrared receiver 40 along with optical paths therebetween. The first and the second infrared emitters 34 and 38 include a first and a second light emitting diodes D1 and D2, respectively, and the reflector 20 includes a photo transistor PD. The light emitting diodes D1 and D2 are disposed at the same heights to each other displaced by a certain distance. In particular, the light emitting diodes D1 and D2 are arranged so that the infrared signals emitted therefrom and reflected by the reflector 20 are directed to the light receiving surface of the photo transistor PD. Hereinbelow, the side of the path of the person passing through the door to which the first infrared emitter 34 is located is referred to as "entrance side," while the side to which the second infrared emitter 38 is located is referred to as "exit side."

Even though not shown in FIG. 3, the infrared emitters 34 and 38 preferably includes respective focusing lenses for focusing emitted infrared signals. Such focusing lenses increase the accuracy of the object detection by directing most of the emitted beam flux to the reflector 20 and reducing the interference of the emitted infrared signals. Also, it is preferable to dispose another focusing lens in front of the photo transistor PD of the infrared receiver 40.

Referring back to FIG. 2, the demodulator 54 of the user interface 50 receives and demodulates the demodulated detection signal from the modulator 46, and provides the demodulated signal to a second microcontroller 52. In the preferred embodiment, the modulator 46 and the demodulator 54 are connected through a radio link as described above. The second microcontroller 52 generates a chime control signal and a counting control signal in response to the demodulated detection signal. A memory 62, which is preferably an EEPROM, stores program codes for operating the microcontroller 52 and the other setup data. In addition to the memory 62, another memory comprising of a random access memory may be further included to the user interface 50.

A chime 56 receives the chime control signal and rings according to the control signal. The chime 56, which rings when a person passes through the door, rings in different ways depending on whether the person enters or exits the room. For example, the chime may ring just once when the person enters the room, while ringing when the person exits the room. The display 58, which is implemented by use of a plurality of seven-segment LED display device or a LCD panel, receives the counting control signal and updates the displayed number. One of several display modes available in the present invention is selected by the manipulation of an input unit 60. In one display mode, the displayed number is up counted whenever a person enters the room. In another display mode, the displayed number is up counted whenever a person enters the room while being down counted when the person or another exits the room. In such a mode, the displayed number indicates the number of persons remaining in the room. Meanwhile, the input unit 60 allows the operator to change the operation mode or reset the system.

On the other hand, the signal generating and determining unit 30 includes a circuit enabling the user to check the alignment of the reflector 20 and the signal generating and determining unit 30. To be more specific, the infrared receiver 40 includes the level determination circuit for determining the levels of the reflected infrared signals. The infrared receiver 40 provides the first microcontroller 44 a first and a second level determination signal indicating the levels of the first and the second reflected signals. The infrared receiver 40 deactivates the first level determination signal when the level of the first reflected signal is below a certain threshold. Similarly, the infrared receiver 40 deactivates the second level determination signal when the level of the second reflected signal is below the threshold.

If either the first or the second level determination signal is deactivated, the first microcontroller 44 controls the first pulse generator 32 such that the first infrared emitter 32 does not emit the first infrared signal. In case that both the first and second level determination signals are deactivated, the first microcontroller 44 controls the first and the second pulse generators 32 and 36 such that the first and the second infrared emitters 32 and 38 do not emit the infrared signals. Accordingly, the user can check the alignment of the reflector 20 and the signal generating and determining unit 30 based on the emitting states of the first and the second infrared emitters 32 and 38.

Figure 4A:
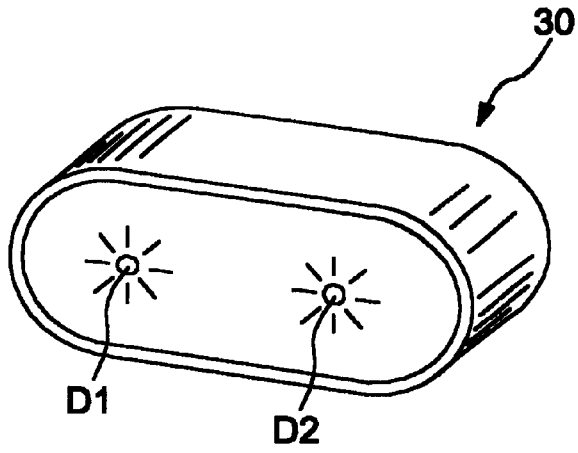
FIGS. 4A through 4C illustrate examples of emissions of the infrared emitters indicating the alignment status of the reflector and the signal generating and determining unit.
Figure 4B:
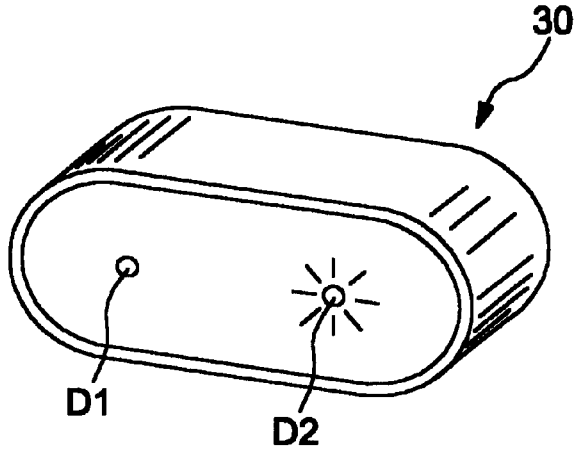
Figure 4C:
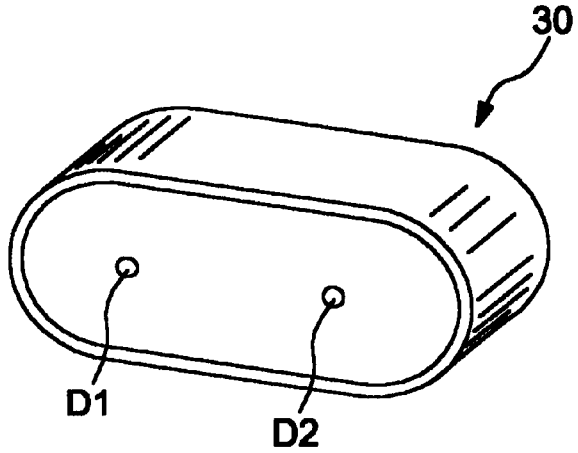

For example, if both the first and the second light emitting diodes D1 and D2 are turned on as shown in FIG. 4A, any further alignment for the reflector 20 or the signal generating and determining unit 30 is not required. In case that the first light emitting diode D1 is turned off but the second light emitting diode D2 is turned on, however, as shown in FIG. 4B, the user has to move the reflector 20 or change the direction of the signal generating and determining unit 30. In case that both the first and the second light emitting diodes D1 and D2 are turned off as shown in FIG. 4C, the user has to displace of the reflector 20 and rotate the signal generating and determining unit 30 in more extent.

In the preferred embodiment, the first pulse generator 32, the second pulse generator 36, the discriminator 42, and the microcontroller 44 may be integrated into a single-chip central processing unit (CPU). In such a case, an interface circuit may be incorporated between the single chip CPU and the first and second infrared emitter 34 and 38, and the infrared receiver 40, so that the number of input/output pins of the single chip CPU is reduced. Meanwhile, in another embodiment of the present invention, the first pulse generator 32 and the second pulse generator 36 may be implemented by a single pulse generator and a demultiplexer which demultiplexes a pulse train from the single pulse generator into two pulse trains having a frequency half of that from the single pulse generator. In still another alternative, the first and second pulse generators 32 and 36 may consist of two dividing circuits which output pulse trains out of phase by a half of the period from each other.

Now, the operation of the system of FIG. 2 will be described with reference to FIGS. 5A through 8.

Figure 5A:
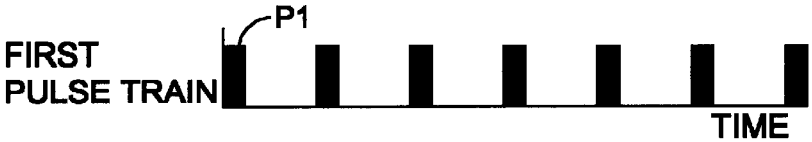
FIGS. 5A through 5C illustrate examples of optical pulse trains emitted by the infrared emitters and an optical pulse train received by the infrared receiver when no object exists between the reflector and the signal generating and determining unit.
Figure 5B:
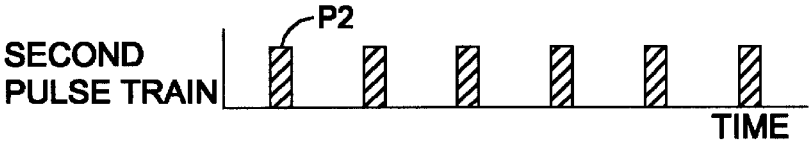
Figure 5C:
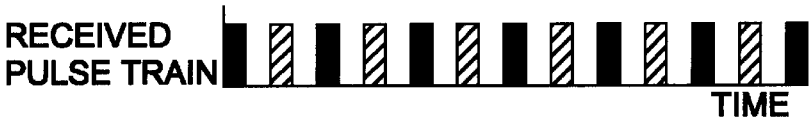

FIGS. 5A through 5C illustrate examples of optical pulse trains emitted by the infrared emitters 34 and 38 and an optical pulse train received by the infrared receiver 40 when no person exists between the reflector 20 and the signal generating and determining unit 30. The first optical pulse train emitted by the first infrared emitter 34 includes consecutive infrared pulses P1, each spaced apart from adjacent pulses by a certain period. The second optical pulse train emitted by the second infrared emitter 38 includes consecutive infrared pulses P2 having the same duty and period as those of the pulses P1. The first optical pulse train is out of phase from the second optical pulse train by a half of the period. The optical pulse train received by the infrared receiver 40 has a form in which the first and the second optical pulse train are superimposed as shown in FIG. 5C.

On the other hand, in an alternative of the present embodiment, the pulses P1 and P2 emitted by the first and the second infrared emitters 34 and 38, respectively, may be pulse groups including a plurality of pulses having shorter periods. Further, the pulses P1 and P2 may be modulated using modulation schemes or modulation indexes different from each other. According to such embodiments, the system can detect the object precisely even when the reflected optical pulse trains interfere with each other.

Figure 6A:
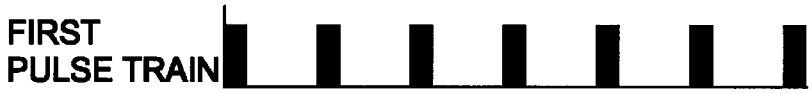
FIGS. 6A through 6C illustrate examples of optical pulse trains emitted by the infrared emitters and an optical pulse train received by the infrared receiver when an object moves from an entrance side toward an exit side.
Figure 6B:
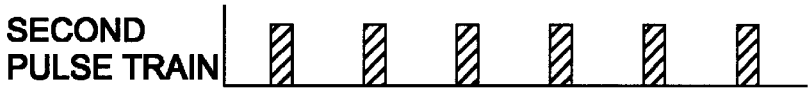
Figure 6C:
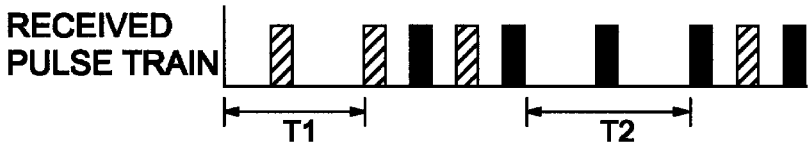

In the case that a person moves from the entrance side to the exit side, the system of FIG. 2 operates as follows. Referring to FIG. 3, When the person enters from the entrance side, the person blocks the first optical pulse train from the first infrared emitter 34. At this time, the infrared receiver 40 does not receive the first optical pulse train reflected by the reflector 20. Subsequently, as the person proceeds further toward the door, the person blocks the second optical pulse train from the second infrared emitter 38. At this time, the infrared receiver 40 does not receive the second optical pulse train reflected by the reflector 20. Accordingly, the optical pulse train received by the infrared receiver 40 has a form shown in FIG. 6C. In FIG. 6C, T1 represents the interval during which the first optical pulse train is blocked, and T2 represents the interval during which the second optical pulse train is blocked.

Figure 7A:
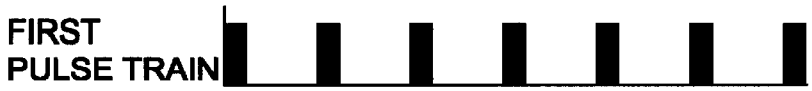
FIGS. 7A through 7C illustrate examples of optical pulse trains emitted by the infrared emitters and an optical pulse train received by the infrared receiver when an object moves from the exit side toward the entrance side.
Figure 7B:
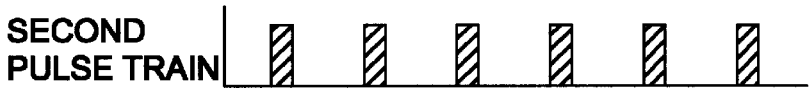
Figure 7C:
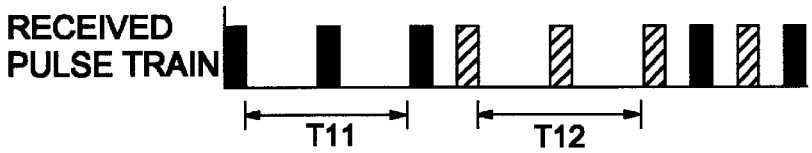

FIGS. 7A through 7C illustrate optical pulse trains emitted by the infrared emitters 34 and 38 and the optical pulse train received by the infrared receiver 40 when a person moves from the exit side toward the entrance side. In case that the person moves from the exit side to the entrance side, the person blocks first the first optical pulse train from the second infrared emitter 38. At this time, the infrared receiver 40 does not receive the second optical pulse train reflected by the reflector 20. Subsequently, as the person proceeds further, the person blocks the second optical pulse train from the first infrared emitter 34. At this time, the infrared receiver 40 does not receive the first optical pulse train reflected by the reflector 20. Accordingly, the optical pulse train received by the infrared receiver 40 has a form shown in FIG. 7C. In FIG. 7C, T11 represents the interval during which the second optical pulse train is blocked, and T12 represents the interval during which the first optical pulse train is blocked.

The infrared receiver 40 converts the received optical pulse train into electrical form. The discriminator 42 determines that a person passes through the door. In particular, the discriminator 42 determines that the person enters the room in case that the interval in which the second pulse train is blocked precedes the interval in which the first pulse train is blocked as shown in FIG. 7C. The discriminator 42 determines that the person exits the room in case that the interval in which the first pulse train is blocked precedes the interval in which the second pulse train is blocked as shown in FIG. 6C. The discriminator 42 provides the discrimination result to the first microcontroller 44, which, in turn, transmits the detection signal to the user interface 50 so that the chime 56 rings and the number of the display 58 is updated.

In the preferred embodiment, the chime sounds a warning beep pulse and the display 58 neither increments nor decrements the displayed number in case that the interval in which the first pulse train is blocked is not followed by the interval in which the second pulse train is blocked in a certain time period or the interval in which the second pulse train is blocked is not followed by the interval in which the first pulse train is blocked in the time period. Such a time period is set by the manufacture depending on the application but can be adjusted by the user. For example, a longer time period is set for the monitoring of cars in a drive-through shop than for the monitoring of human beings passing through a gate.

Figure 8:
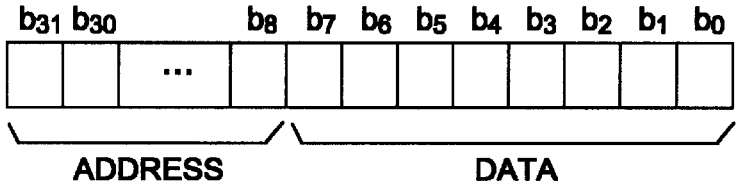
FIG. 8 illustrates an example of the format of the signal transferred between the signal generating and determining unit and the user interface.

As mentioned above, the signal generating and determining unit 30 is connected to the user interface 50 through a wireless link. FIG. 8 illustrates an example of the format of the signal transferred between the signal generating and determining unit 30 and the user interface 50. Referring to FIG. 8, a data frame is comprised of 32 bits, of which upper twenty-four bits ($b_{31}$–$b_8$) includes an identification number of the signal generating and determining unit 30 and the remaining eight bits ($b_7$–$b_0$) includes physical data regarding the detection of objects.

Multiple signal generating and determining unit 30 may be interfaced to a single user interface 50. In such an application, the reflector 20 and the signal generating and determining unit 30 is installed at each door of the office or the building. The user interface 50 can be programmed to handle the detection data from all the signal generating and determining units 30 and control all the signal generating and determining units 30. Alternatively, however, the user interface 50 may be programmed to handle the detection data from some of the signal generating and determining units 30 and control such units 30.

In this regard, the system has a learning capability for the interface between the signal generating and determining unit 30 and the user interface 50. In other words, the user interface 50 may be interfaced to some specific signal generating and determining units 30 designated by the user. If the user presses a "CODE LEARNING" key of the input unit 60 for a certain time, the user interface 50 enters a code learning mode. When a signal is transmitted from a new signal generating and determining unit 30 to the user interface 50 in such a mode, the identification number included in the signal is recognized by the second microcontroller 52 to be stored in the memory 62. Just the signal generating and determining units 30 of which identification numbers are stored in the memory 62 can communicate with the user interface 50. When the code learning is completed for the new signal generating and determining unit 30, the user may press the "CODE LEARNING" key so that the user interface 50 exits the code learning mode.

The object detection system according to the present invention may be used in various applications. For example, the system can be used, in an office or a clinic, for checking the number of visitors. Also, the system can be deployed, in a toll gate in a parking lot or an expressway. Depending on the application, the periods of the pulses P1 and P2 shown in FIGS. 5A and 5B can be optimized by the user's programming. Further, the system according to the present invention may be zip utilized as an alarm system in a night operation mode, in which the chime rings continuously from the instant a person enters the room. Unless a rightful person resets the system by inputting a command through the input unit 60, the user interface may report the trespass to an external security service company.

Having described and illustrated the principles of the invention in preferred embodiments and alternatives thereof, it should be apparent that the invention can be modified in arrangement and detail without departing from such principles.

For example, in another embodiment of the present invention, the signal generating and determining unit 30 may further include a voice chip, so that the system outputs a sound of "Welcome!" when a person enters the room and a sound of "Thank you. Have a nice day." when a person exits the room. While the signal generating and determining unit 30 and the user interface 50 are interfaced through the wireless channel in the preferred embodiment, the signal generating and determining unit 30 and the user interface 50 may, alternatively, be connected by a wire. Also, a demodulator and modulator may further be provided to the signal generating and determining unit 30 and the user interface 50, respectively, to facilitate bidirectional communications between the signal generating and determining unit 30 and the user interface 50.

Figure 9:
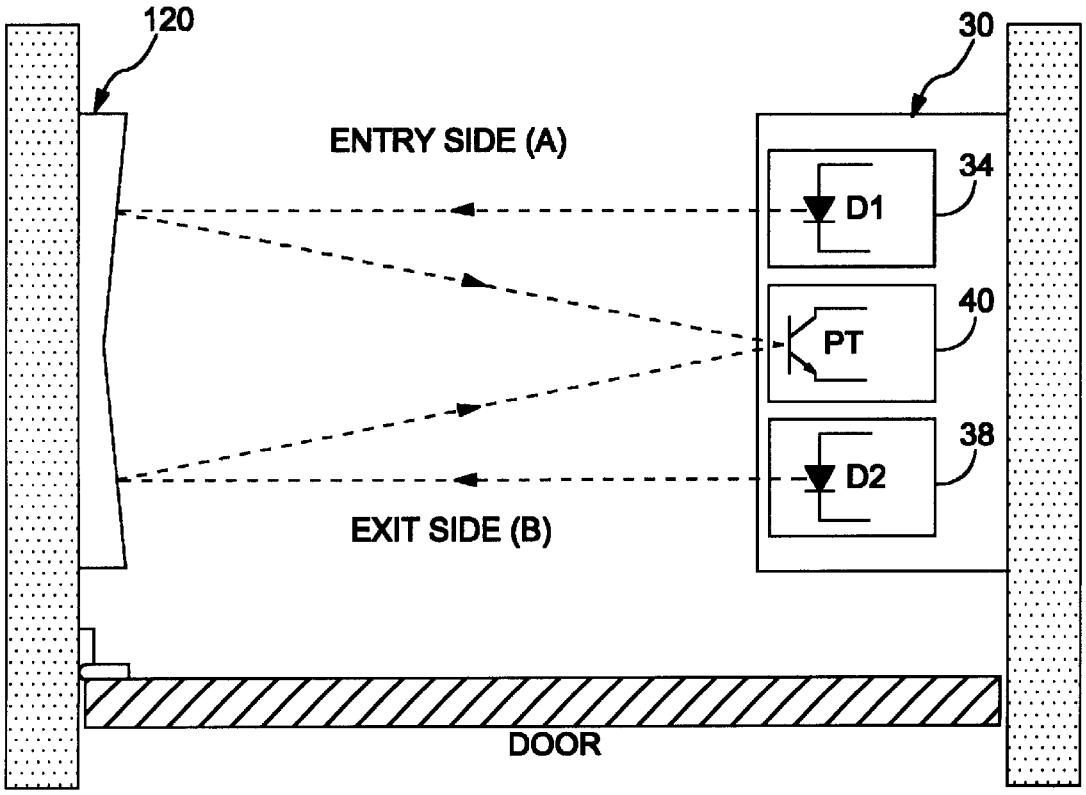
FIG. 9 illustrates another embodiment of the sensor assembly according to the present invention.

On the other hand, the reflector 20 has a shape of a flat panel in the embodiment shown in FIG. 3, the reflector 20 may have a shape of being flexed along its vertical center, alternatively as shown in FIG. 9. According to the embodiment, it is unnecessary to align the infrared emitters 34 and 38 so that the optical pulse trains reflected by the reflector 20 fall precisely to the light receiving surface of the infrared receiver 40.

Figure 10:
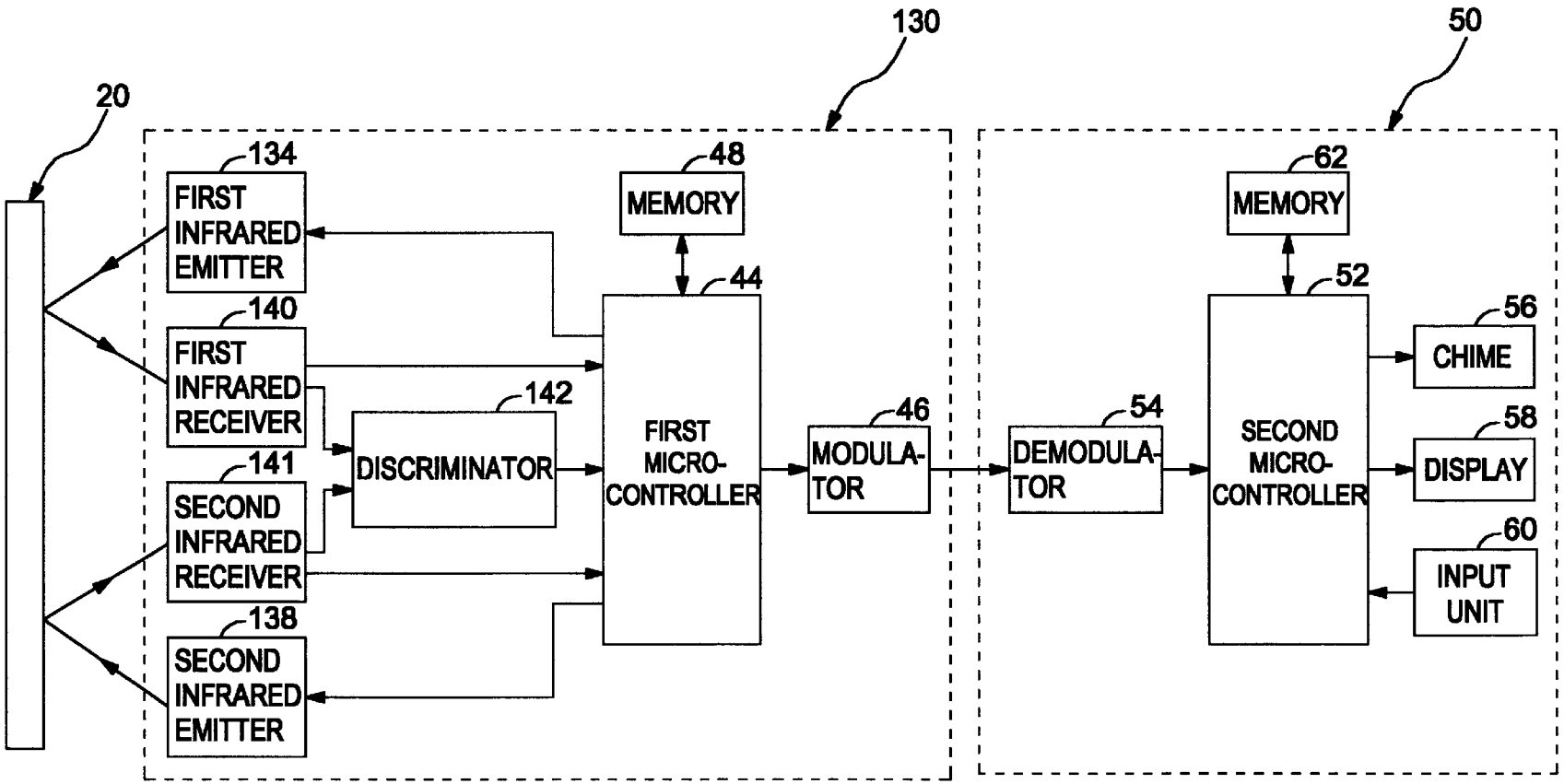
FIG. 10 illustrates another embodiment of the object detection system according to the present invention.

Further, even though the infrared emitters 34 and 38 emit optical pulse trains in the preferred embodiment, the infrared emitters may continuously emit constant infrared. FIG. 10 illustrates such an embodiment. In FIG. 10, a third and a fourth infrared emitters 134 and 138 radiate constant infrared of which frequencies are different from each other. The first infrared receiver 140 converts the infrared emitted by the third infrared emitter 134 into an electrical form, and the second infrared receiver 141 converts the infrared emitted by the fourth infrared emitter 138 into an electrical form. A discriminator 142 determines the presence and direction of an object passing through a gate based on the signals from the first and the second infrared receivers 140 and 141.

Figure 11:
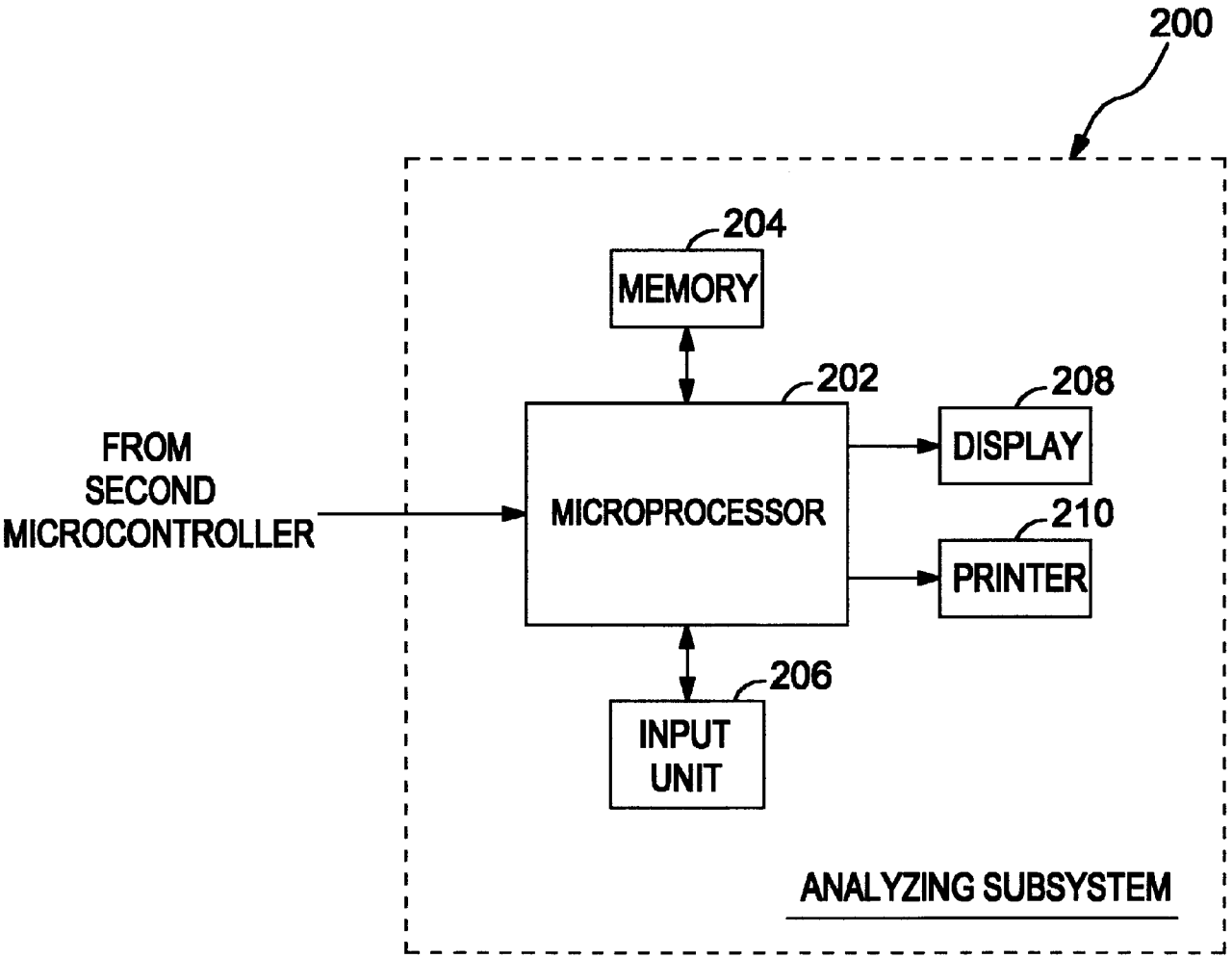
FIG. 11 is a block diagram of an analyzing subsystem for providing statistics of the objects having passed through the gate.

The system of FIG. 2 or FIG. 10 may include an analyzing subsystem for providing statistics of the objects having passed through the gate. FIG. 11 illustrates example of such an analyzing subsystem. The analyzing subsystem 200 of FIG. 11 includes a microprocessor 202, a memory 204, an input unit 206, a display 208, and a printer 210. The microprocessor 202 is interfaced, through a wire, to the second microcontroller 52 of the user interface 50. The microprocessor 202 receives the counted data of entry objects or exit objects to store such data in the memory 204. Afterwards, the microprocessor 202 carries out statistical operations in response to the instruction of the user. The display 208 and the printer 210 provides the statistical data to the user.

Thus, although the present invention has been described in detail above, it should be understood that the foregoing description is illustrative and not restrictive. Those of ordinary skill in the art will appreciate that many obvious modifications can be made to the invention without departing from its spirit or essential characteristics. We claim all modifications and variation coming within the spirit and scope of the following claims:

What is claimed is:

1. A system for detecting an object passing through a gate supported laterally by a frame, said system comprising:

a reflector disposed at an edge of the frame;

signal generating and determining means, disposed at the other edge of the frame so as to face said reflector, for generating a first and a second infrared beams to emit to said reflector, receiving a mixed beam in which the first and the second beams reflected by said reflector are superimposed, and determining the presence and direction of the object passing through the gate based on the mixed beam; and a user interface for notifying a user of the presence and direction of the object when the object passes through the gate and receiving an operation command from the user, wherein said signal generating and determining means comprises a first and second infrared emitters for generating the first and the second infrared beams, respectively, wherein said first and said second infrared emitters are mounted in a single housing.

2. The system of claim 1, wherein said signal generating and determining means generates a first and a second pulse trains having a same period to each other to modulate the first and the second infrared beams according to the first and the second pulse trains, respectively, generating a received pulse train according to the mixed beam, and determining the presence and direction of the object using the received pulse train, wherein the first and the second pulse trains are out of phase by a half of the period.

3. The system of claim 2, wherein said signal generating and determining means further comprises:

a first determination and control unit;

a first and a second pulse generators for generating the first and the second pulse trains to provide to the first and the second infrared emitters, respectively; and an infrared receiver for receiving the mixed beam to generate the received pulse train;

wherein said first determination and control unit determines the presence and direction of the object using the received pulse train and outputs a data frame including a detection data representing the presence and direction of the object to said user interface.

4. The system of claim 3, wherein said signal generating and determining means further comprises:

a memory for storing a program code for operating said first determination and control unit.

5. The system of claim 3, wherein said user interface comprises:

a second determination and control unit for generating a sound control signal and a counting control signal;

means for generating sound in response to the sound control signal; and a display for displaying a predetermined count in response to the counting control signal.

6. The system of claim 5, wherein said signal generating and determining means further comprises a modulator for modulating the data frame to output a modulated data frame through a predetermined channel, wherein said user interface further comprises a demodulator for receiving the modulated data frame through the predetermined channel and demodulating the modulated data frame to provide a demodulated data frame to said second determination and control unit.

7. The system of claim 6, wherein the data frame includes an identification number of said signal generating and determining means.

8. The system of claim 6, wherein the predetermined channel is a wireless channel.

9. The system of claim 1, wherein each of the first and the second infrared beams has a constant waveform, wherein wavelengths the first and the second infrared beams are different from each other.

10. The system of claim 1, wherein a plurality of said reflectors and said signal generating and determining means are provided so as to monitor objects passing through the plurality of gates, each of the plurality of said reflectors and said signal generating and determining means being installed at respective one of the plurality of gates, wherein the plurality of said signal generating and determining means are connected to said user interface.

11. The system of claim 1, said signal generating and determining means further comprises:

means for determining an alignment state of said signal generating and determining means with respect to said reflector.

12. A sensor assembly for use in a system for detecting an object passing through a gate, said sensor assembly comprising:

a reflector; and an infrared transceiver, being disposed to face said reflector, for generating a first and a second infrared beams to emit to said reflector and receiving a mixed beam in which the first and the second beams reflected by said reflector are superimposed, wherein said infrared transceiver comprises a first and second infrared emitters for generating the first and the second infrared beams, respectively, wherein said first and said second infrared emitters are mounted in a single housing.

* * * * *